US005456228A

United States Patent [19]

Meurer et al.

[11] Patent Number: 5,456,228

[45] Date of Patent: Oct. 10, 1995

[54] MAIN BEARING CONSTRUCTION FOR INTERNAL COMBUSTION ENGINE

[75] Inventors: Joseph Meurer, Troisdorf; Gottfried Weber, Cologne; Hans-Walter Metz, Pulheim, all of Germany; Edmund Lenerz, Hatfield Prverel, Great Britain

[73] Assignee: Ford Motor Company, Dearborn, Mich.

[21] Appl. No.: 340,979

[22] Filed: Nov. 17, 1994

[51] Int. Cl.[6] ..... F02F 7/00

[52] U.S. Cl. ..... 123/195 H

[58] Field of Search ..... 123/195 R, 195 H

[56] References Cited

U.S. PATENT DOCUMENTS 3,841,203 10/1974 Bruce ..... 123/195 H

FOREIGN PATENT DOCUMENTS 115471 12/1929 Germany .
3322861C2 5/1985 Germany .
3532599C2 5/1987 Germany .

*Primary Examiner*—Noah P. Kamen
*Attorney, Agent, or Firm*—Jerome R. Drouillard; Roger L. May

[57] ABSTRACT

An internal combustion engine includes a bearing cap (3) for positioning the crankshaft (40) within the cylinder block (1). Spacer sleeves (20), which are attached with the main bearing cap bolts (5), are provided with dowel pins (32) having free ends (33) extending therefrom. The free ends of the dowel pins are mated with pockets (34) formed on the inner surface of the reinforcement element. A hardenable material (38) is injected into the space formed between the dowel pins and the pockets so as to form a locked reinforcement element to each of the dowel pins.

3 Claims, 1 Drawing Sheet

MAIN BEARING CONSTRUCTION FOR INTERNAL COMBUSTION ENGINE

BACKGROUND OF THE INVENTION

The present invention relates to a structure and method for mounting the crankshaft within a reciprocating internal combustion engine.

Disclosure Information

Although internal combustion engines conventionally include a crankshaft mounted in a cylinder block by bearing caps, the present invention has not only bearing caps, but also a reinforcement component supported by the oil pan rail of the engine block and by the bearing caps. The reinforcement greatly increases the overall rigidity of the internal combustion engine, which improves its quiet-running ability by reducing its noise radiation.

In certain known internal combustion engines, cylinder block reinforcing is connected to the oil pan rail of the cylinder block by threaded bolts, with other threaded bolts extending from the reinforcement component directly into threaded orifices in the crankshaft bearing caps. Unfortunately, this construction requires considerable modifications to the original shape of the conventional bearing caps in order to permit connection with the reinforcing element. And, the tolerancing required for this type of construction may render the structure excessively expensive and time consuming to manufacture.

An advantage of the present invention resides in the fact that the original shape of the crankshaft bearing caps and their attachment can be essentially maintained, while still providing for a connection to react to the lateral loads between the bearing caps and the reinforcing element. And, the reinforcement can be removed from the engine without having to remove the bearing cap bolts.

SUMMARY OF THE INVENTION

According to the present invention an internal combustion engine, having a crankshaft mounted in the cylinder block by means of a plurality of bearing caps which position the crankshaft within the block, has a reinforcement element positioned between the oil pan rail of the cylinder block and the bearing caps. A plurality of spacer sleeves is attached to the bearing caps, with at least two sleeves being attached to each of the bearing caps by means of the threaded bolts which are used to maintain the caps mounted to the cylinder block. A plurality of dowel pins is included in the present construction, with one of the dowel pins being pressed into each of the spacer sleeves, and with each of the dowels having a free end extending from its mating spacer sleeve into a pocket formed on the inner surface of the reinforcement element. A hardenable material is injected into a space formed between each of the dowel pins and its mating pocket. This hardenable material form Locks the reinforcement element to each of the dowel pins.

It is an advantage of the present invention that, as noted above, the reinforcement may be used without changing the shapes of the bearing caps, and, while allowing the reinforcement to be removed without disturbing the bearing caps. Other advantages will become apparent to the reader of this specification.

DETAILED DESCRIPTION OF THE PREFERRED EMBODIMENT

Figure 1:
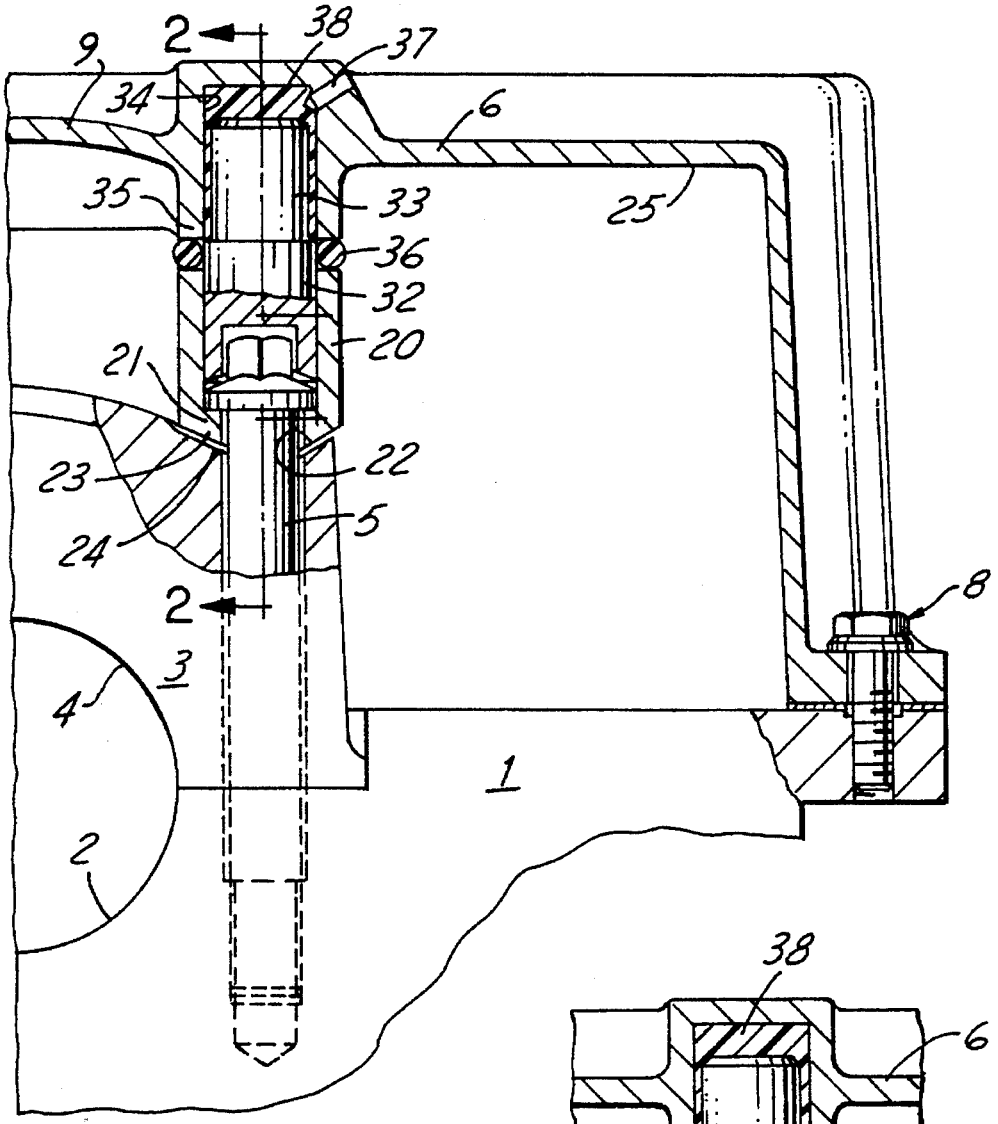
FIG. 1 is a vertical partial cross-section through a main bearing according to the invention.
Figure 2:
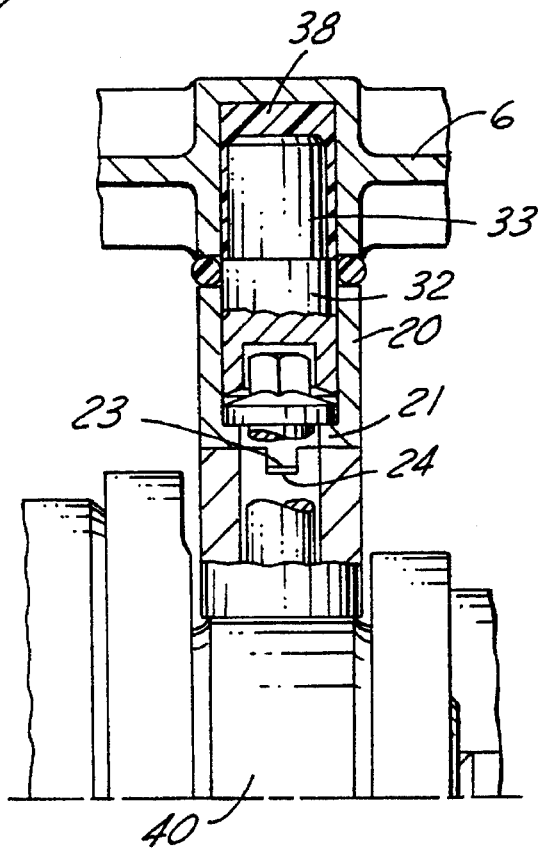
FIG. 2 is a side view, partially broken away, of the bearing of FIG. 1, taken along the line 2—2 of FIG. 1.

FIG. 1 illustrates a partial segment of cylinder block 1 of an internal combustion engine. The lower part 2 of a bearing opening for crankshaft 40 (FIG. 2) is formed in cylinder block 1 itself. Bearing cap 3 includes an upper part 4 of a bearing opening for crankshaft 40 and is connected to cylinder block 1 by at least two threaded bolts 5.

Reinforcement element 6 for cylinder block 1 is connected to oil pan rail 7 by a number of bolts 8.

A plurality of spacer sleeves 20, which are held in place by bolts 5, are used to mount a plurality of dowel pins 32, which are pressed into spacer sleeves 20. Each of dowel pins 32 has a free end 33, which protrudes into a dead-ended pocket 34 formed in the inner surface 25 of reinforcement element 6. O-ring seals 36 are placed on reinforcement component 6 between each spacer sleeve 20 and each sleeve attachment 35. A plurality of bores 37 lead from the outside into pockets 34. The attachment in this implementation occurs as follows: reinforcement element 6 is fastened in the conventional manner with the bolts provided at oil pan rail 7 and then the internal combustion engine can be run through a test, for example, so that the various components become settled. After this engine test, a hardenable material 38, for example plastic, is injected through a plurality of bores 37 into the space between free end portion 33 of each dowel pin 32 and its mating dead-ended pocket 34, and cured. This form locks reinforcement element 6 to each of dowel pins 32, while allowing compensation between the axial and radial production and assembly tolerances, and in the event that reinforcement element 6 also functions as the engine's oil pan, the lower part of the engine can still be disassembled and re-assembled to allow maintenance and repairs.

While the invention has been shown and described in its preferred embodiments, it will be clear to those skilled in the arts to which it pertains that many changes and modifications may be made thereto without departing from the scope of the invention.

We claim:

1. An internal combustion engine comprising:

a crankshaft mounted in a cylinder block (1);

a plurality of bearing caps (3) for positioning the crankshaft (40) within the cylinder block (1), with each of said caps being held in place by a plurality of bolts (5);

a plurality of spacer sleeves (20), with at least two of said sleeves being attached to each of said main bearing caps by means of one of threaded bolts (5);

a plurality of dowel pins (32), with one of said dowel pins being pressed into each of said spacer sleeves, and with each of said dowels having a free end (33) extending from its mating spacer sleeve;

a reinforcement element (6) which is attached to an oil pan rail (7) of cylinder block (1), as well as to bearing caps (3), with said reinforcement element comprising:

a first portion attached by means of a plurality of fasteners to the oil pan rail (7) of the cylinder block (1) and having an inner surface (25) extending to the location of said bearing caps; and a plurality of pockets (34) formed on the inner surface (25) of said reinforcement element for receiving said dowel pins (32); and a hardenable material (38), injected into a space formed between said dowel pins and said pockets, for form locking said reinforcement element to each of said dowel pins.

2. An internal combustion engine according to claim 1, wherein said hardenable material is injected after the engine has been run for a predetermined period.

3. A method for stabilizing the lower crankcase of an internal combustion engine having a crankshaft mounted within the crankcase by means of main bearing caps retained by bolts, comprising the steps of:

bolting a plurality of sleeves to the main bearing caps using said bolts;

inserting a plurality of dowel pins into said sleeves such that a free end of each pin projects outwardly from the sleeve into which it is pressed;

bolting a reinforcement element, having pockets which mate with the free ends of said dowel pins, to a peripheral surface of the cylinder block; and injecting a hardenable material into a space defined by the free ends of the dowels and the pockets.

* * * * *